United States Patent [19]

Song et al.

[11] 4,272,076

[45] Jun. 9, 1981

[54] TETHERABLE GAME BALL

[76] Inventors: Jae M. Song, 225/46 Yeunhi/dong, MA PO/KU, Seoul, Rep. of Korea; Samuel B. Ligon, 5505 Emerson, Dallas, Tex. 75209

[21] Appl. No.: 103,458

[22] Filed: Dec. 14, 1979

[51] Int. Cl.[3] ..... A63B 39/00; A63B 43/02

[52] U.S. Cl. ..... 273/58 C; 273/58 A

[58] Field of Search ..... 273/413, 414, 58, C, 273/26 E, 198, 200 R, 200 A, 184 B, 185 C, 330, 58 B, 58 K, 58 BA, 29 A, 329–331

[56] References Cited

U.S. PATENT DOCUMENTS

| | | | |
|---|---|---|---|
| 211,420 | 1/1879 | Moses | 273/58 C |
| 1,439,338 | 12/1922 | Smith | 273/198 |
| 1,439,339 | 12/1922 | Smith | 273/198 |
| 1,629,364 | 5/1927 | Scholly | 273/58 B |
| 2,115,926 | 5/1938 | Hatton | 273/58 C |
| 2,747,873 | 5/1956 | Carroad | 273/58 C X |
| 2,942,883 | 6/1960 | Moore | 273/26 E |
| 3,051,491 | 8/1962 | Cabot | 273/200 R |
| 4,162,790 | 7/1979 | Kelsey | 273/413 |
| 4,186,921 | 2/1980 | Fox | 273/58 C X |

FOREIGN PATENT DOCUMENTS

| | | | |
|---|---|---|---|
| 655781 | 1/1963 | Canada | 273/58 C |
| 662796 | 5/1963 | Canada | 273/58 B |
| 597176 | 5/1934 | Fed. Rep. of Germany | 273/58 C |
| 11887 | of 1901 | United Kingdom | 273/200 R |

*Primary Examiner*—George J. Marlo
*Attorney, Agent, or Firm*—Richards, Harris & Medlock

[57] ABSTRACT

A tetherable game ball is provided that includes a resilient hollow ball (48) having an aperture (52) through which a line (54) having two ends extends therethrough to a position within the hollow ball (48) to form a loop located exteriorly of the ball (48) for allowing a tether to be secured thereto. Each end of the line (54) that is located within the hollow ball (48) forms a knot (56, 58) for restraining the line (54) from being pulled through the aperture (52). The game ball can be constructed so as to have rebound and elastic properties similar to those of a racquet ball.

4 Claims, 7 Drawing Figures

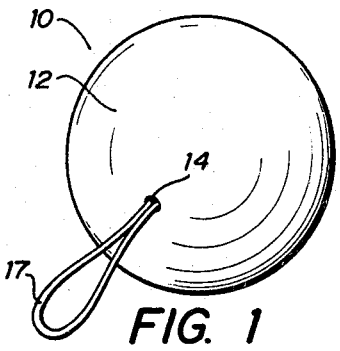
FIG. 1
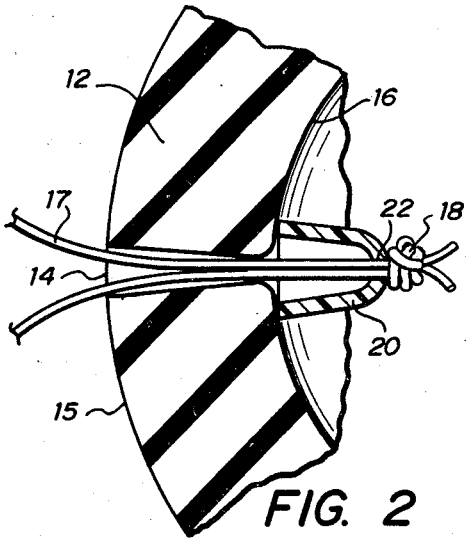
FIG. 2
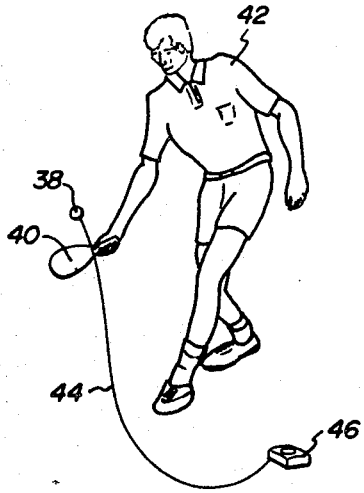
FIG. 5
FIG. 3
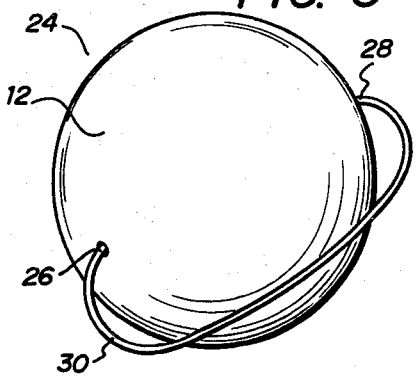
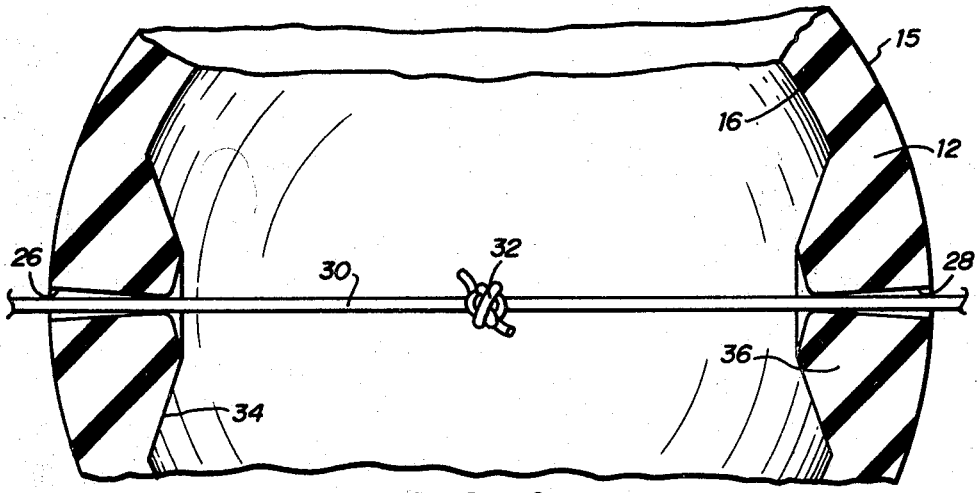
FIG. 4

TETHERABLE GAME BALL

TECHNICAL FIELD

This invention relates to game balls, and more particularly to game balls that are securable to a tether.

BACKGROUND ART

In the past, many games have been developed that utilize a game ball that is tethered. These games often involve the use of paddles, bats, golf clubs or other implements that are used to strike the game ball. Substantial forces are exerted on the game ball when it is accelerated by the striking implement and substantial forces are also exerted upon the game ball when it encounters the resistance of the tether. Typical tetherable game balls are described and claimed in U.S. Pat. Nos. 660,787 issued to Bissell on Oct. 30, 1900 entitled "Tether Ball"; 2,747,873 issued to Carroad on May 29, 1956 entitled "Tethered Ball Game Apparatus" and 3,051,491 issued to Cabot on Aug. 28, 1962 and entitled "Returnable Practice Golf Ball".

A need has thus arisen for a tetherable game ball that is simple in construction, resists tearing and breaking away from the tether and has characteristics of an untethered ball.

DISCLOSURE OF THE INVENTION

In accordance with the present invention, a tetherable game ball is provided.

In accordance with another aspect of the present invention, a tetherable game ball is provided that is hollow and the construction of the ball allows forces exerted between the ball and the tether to be distributed about a portion of the ball so that tearing of the ball associated with the tether is minimized.

One embodiment of the tetherable game ball of the present invention comprises a resilient, spherical hollow ball having a single aperture therein. The aperture has an inward taper that begins at the exterior surface of the hollow ball and extends over at least a portion of the length of the aperture. A line of predetermined length having both ends passed through the aperture and secured together forms a loop that extends exteriorly of the aperture to allow a tether to be secured to the loop. A plug, having a hole therein, through which said loop is threaded, is located within the ball, between the aperture and the knot formed by the two ends of the line, which knot is larger than the hole in the plug adjacent the knot, so that forces exerted upon the line are distributed by the plug about the aperture and the line cannot be pulled from the ball.

In accordance with a further aspect of the present invention, a hollow, tetherable game ball is provided in which a resilient, spherical hollow ball has two diametrically opposed apertures. Each of the apertures has an inward taper that begins at the exterior surface of the hollow ball and extends over at least a portion of the length of each of the two apertures. A line of predetermined length is passed through said apertures that is knotted at the ends, the knot being larger than the smallest diameter of the aperture and the knot being located within the hollow portion of the ball, the relative size of the aperture and the knot preventing the knot from being pulled outside of the ball. At each aperture, a boss forms an integral part of the ball. The boss is located interiorly of the ball with the apertures extending through the bosses, thereby reinforcing the ball and distributing forces exerted on the ball by the line in an area adjacent the apertures.

In accordance with still another aspect of the invention, a hollow, tetherable game ball is provided having a single aperture therein and a line of predetermined length having two ends extending through the aperture to a position within the hollow ball forming a loop located exteriorly of the hollow ball with each end of the line being independently knotted. These knots are located within the hollow ball for restraining the line from being pulled through the aperture when a force is exerted between the line and the ball. Each of the knots is larger than the diameter of the aperture, the relative size of the aperture and the knot preventing the knots from being pulled outside of the ball. A boss located interiorly of the ball forms an integral part thereof and is adjacent to and surrounds the aperture for reinforcing the ball about the aperture and for distributing forces exerted between the line and the ball. The loop extending exteriorly of the ball formed from the line can be knotted to form an exterior knot at some point between the aperture and the end of the loop so that the portion of the loop between the interior knots and exterior knot functions as a single line.

BRIEF DESCRIPTION OF DRAWINGS

A more complete understanding of the invention and its advantages will be apparent from the following detailed description taken in conjunction with the accompanying drawings in which:

FIG. 1 is a side elevation view of a tetherable ball according to the invention;

FIG. 2 is a side elevational sectional view of part of the tetherable game ball shown in FIG. 1;

FIG. 3 is a side elevational view that illustrates an alternate embodiment of the tetherable game ball according to the invention;

FIG. 4 is a side elevational sectional view illustrating part of the tetherable game ball as shown in FIG. 3;

FIG. 5 is a picture showing the tetherable game ball being used;

DETAILED DESCRIPTION

Figure 6:
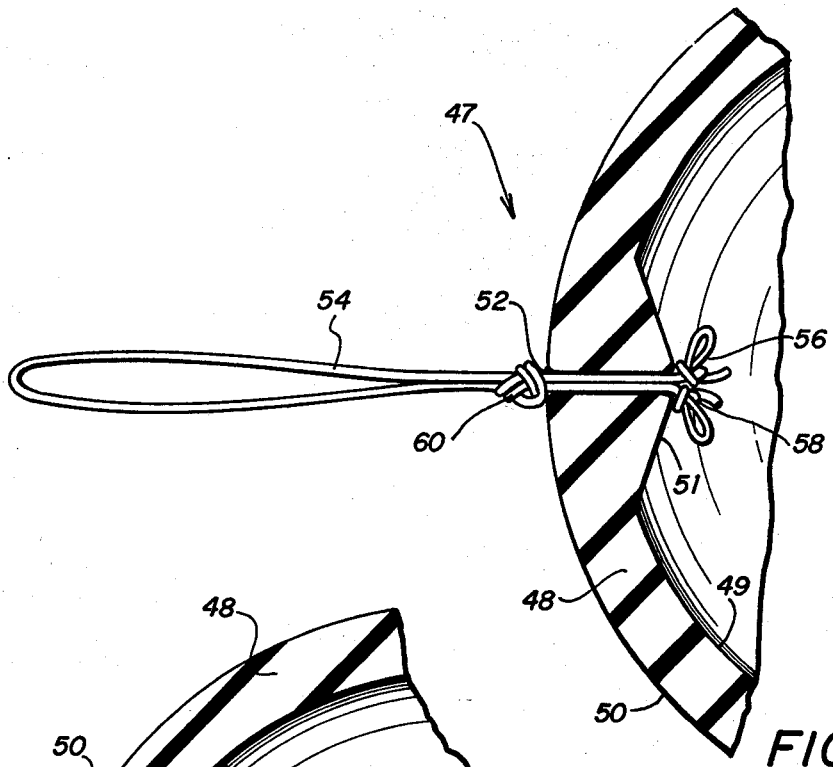
FIG. 6 is a side elevational sectional view of part of a tetherable game ball illustrating still another embodiment according to the invention.

FIG. 1 illustrates one preferred embodiment of the tetherable game ball according to the invention in which a side elevation view of single apertured tetherable game ball 10 is shown. Single apertured tetherable game ball 10 includes a resilient, spherical hollow ball 12 having aperture 14 therein having rebound characteristics similar to those of a racquetball. Preferably, aperture 14 is circular and tapered so that the diameter of aperture 14 decreases along at least a portion of the length of aperture 14 beginning at exterior surface 15 of hollow ball 12. In addition aperture 14 is preferable normal to exterior surface 15.

The decreasing taper of aperture 14 is best illustrated in FIG. 2 which shows a cross-sectional view of a portion of single apertured tetherable game ball 10. According to the invention, and as illustrated in FIG. 2, aperture 14 may be beveled at interior surface 16 of hollow ball 12. A flexible line 17, of predetermined length, may be constructed of nylon or string and has both ends secured together to form knot 18 located within hollow ball 12 forming a loop which passes through aperture 14. In accordance with the invention, structure is provided to distribute forces exerted between hollow ball 12 and line 17 in the area adjacent aperture 14 to provide for a more durable game ball.

In this embodiment, the structure is force distributing plug 20, located within resilient spherical hollow ball 12. Plug 20 also prevents line 17 from being pulled completely out of resilient spherical hollow ball 12 when a force is exerted upon line 17 that may occur, for example, when ball 10 is struck by a racket or when a tether exerts a force on line 17. Force distributing plug 20, a separate structure from hollow ball 12, is preferably wedge shaped or cone shaped having a rounded point and a flat base, oriented such that the flat base is adjacent interior surface 16, as shown in FIG. 2. The diameter of aperture 14 at interior surface 16 is smaller than the base of force distributing plug 20.

Plug 20 can be constructed of any rigid material, such as plastic or metal, and formed into the desired configuration by any method known to those skilled in the art, such as casting or injection molding. In assembling ball 10, both ends of line 17 can be threaded through hole 22 and then tied to form knot 18 while plug 20 is outside hollow ball 12, or the ends of line 17 can first be tied together to form knot 18 and then the loop formed can be inserted through hole 22. After assembly of plug 20 and line 17, knot 18 and plug 20 are inserted through aperture 14 into the hollow portion of ball 12, knot 18 being inserted first and followed by the rounded end of plug 20. The elasticity of hollow ball 12 allows aperture 14 to expand during insertion. Further, the wedge or cone shape of plug 20 facilitates the expansion of aperture 14 thereby facilitating insertion. A thin, rigid rod or other suitable implement can be used to facilitate insertion of plug 20 and knot 18 into the hollow portion of ball 12.

Hole 22 extends preferably through the longitudinal axis of force distributing plug 20, the diameter of hole 22 adjacent knot 18 being sufficiently smaller than the size of knot 18 so that knot 18 cannot pass through hole 22 when a force is exerted on line 17. When a force is exerted on line 17, plug 20 contacts resilient spherical hollow ball 12 adjacent aperture 14. When this occurs, the force exerted on line 17 is distributed over the area of resilient spherical hollow ball 12 that plug 20 contacts. Thus, reinforcing plug 20 distributes a force exerted upon line 17 over an area adjacent aperture 14 and prevents tearing of the wall of ball 10.

FIG. 3 illustrates another preferred embodiment of a tetherable game ball according to the invention. FIG. 3 is a side elevational view of double apertured tetherable game ball 24 in which the side walls of hollow ball 12 has therein apertures 26 and 28 which are diametrically opposed. Line 30 extends through both apertures 26 and 28, the ends of line 30 being tied to form knot 32 that is located within hollow ball 12. Each of apertures 26 and 28 are inwardly tapered along at least a portion of the length of those apertures, the taper beginning at exterior surface 15. The inward taper of apertures 26 and 28 prevent knot 18 from being pulled from the hollow portion of resilient spherical hollow ball 12, thus enhancing the appearance of the game ball.

Double apertured tetherable game ball 24 is assembled from hollow ball 12 and line 30 by inserting one end of line 30 through apertures 26 and 28 so that both ends of line 30 extend exteriorly of hollow ball 12. A thin wire or a thin rigid rod, or any other suitable implement can be used to facilitate insertion of line 30 through apertures 26 and 28. The ends of line 30 are then tied together to form knot 32 which can then be either pushed or pulled through one of apertures 26 and 28 so that knot 32 is located within hollow ball 12.

FIG. 4 is a side sectional elevational view of the double apertured tetherable game ball illustrated in FIG. 3. The force distribution structure shown in this embodiment consists of two bosses 34 and 36 which form an integral part of resilient spherical hollow ball 12. Bosses 34 and 36 form interior surface 16 adjacent apertures 26 and 28, apertures 26 and 28 extending through bosses 34 and 36, respectively. Bosses 34 and 36 allow distribution of forces exerted on resilient spherical hollow ball 12 by line 30 to prevent tearing of the game ball in the area adjacent apertures 26 and 28, making the game ball more durable. As shown in FIG. 4, apertures 26 and 28 are identical, and may include a shallow bevel at interior surface 16 of hollow ball 12 around each of apertures 26 and 28.

A tether is secured to line 30 by any suitable means, such as by tying a tether to line 30. The tether may be attached to a fixed location such as a base as shown in U.S. Pat. No. 2,747,873.

Figure 7:
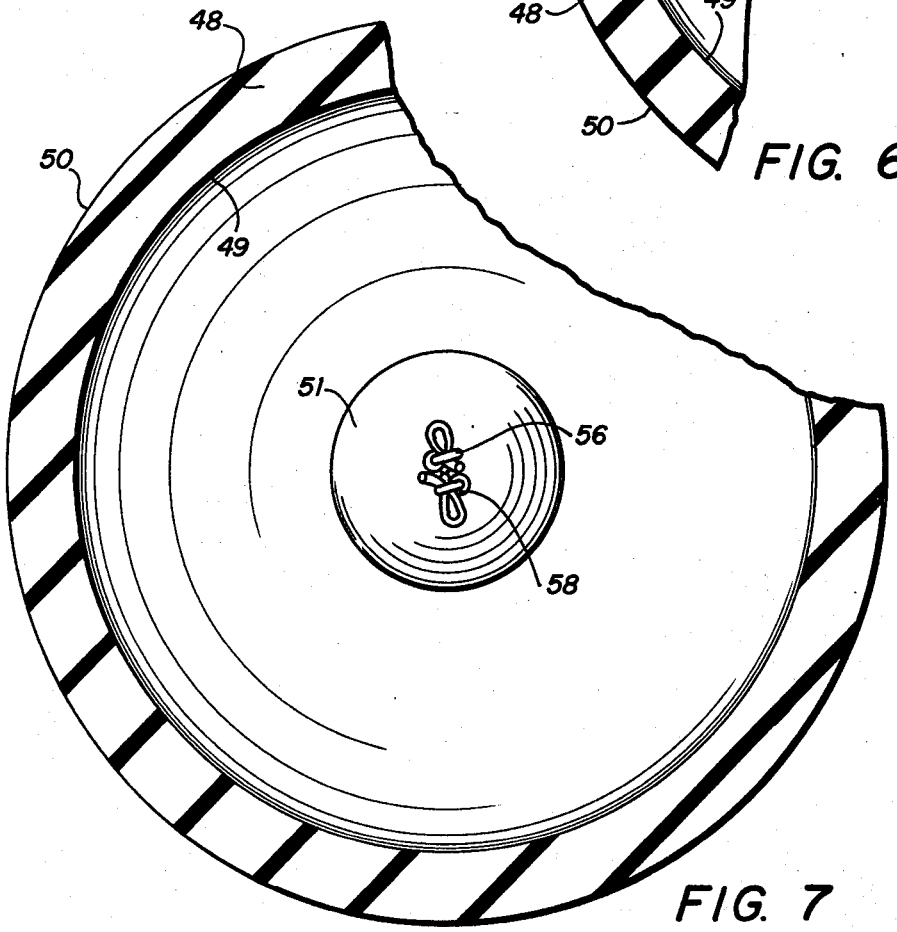
FIG. 7 is a front elevational sectional view of the embodiment shown in FIG. 6.

Referring generally to FIGS. 6 and 7, there is illustrated another preferred embodiment in accordance with the present invention. A single apertured tetherable game ball 47 is provided that includes resilient spherical hollow ball 48 having an interior surface 49 and an exterior surface 50. Hollow ball 48 is similar in construction and characteristics to resilient spherical hollow ball 12 described herein with several modifications and can be manufactured in a similar manner. A boss 51 is located interiorly of hollow ball 48 and forms an integral part thereof. An aperture 52 extends between exterior surface 50 and interior surface 49 of hollow ball 48 and through boss 51. Aperture 52 may be inwardly tapered as aperture 14, previously described, or, as shown in FIG. 6, have no taper. As shown in FIG. 6, aperture 52 may be beveled slightly at the interior and exterior surfaces of hollow ball 48. Boss 51 which surrounds aperture 52 is preferably conically shaped having its base portion adjacent interior surface 49 of hollow ball 48 with aperture 52 extending through the apex of boss 51. Boss 51 serves to reinforce hollow ball 48 adjacent aperture 52 and to distribute forces between the flexible line connected to hollow ball 48 as hereinafter described.

A flexible line 54 has two ends that extend through aperture 52 to a position within hollow ball 48 to form a loop located exteriorly of hollow ball 48 and is securable to a tether. Flexible line 54 is similar in construction to flexible lines 17 and 30, described herein. Each end of line 54 is separately knotted to form knots 56 and 58, which are located within hollow ball 48. Each of knots 56 and 58 are larger than the diameter of aperture 52 to prevent knots 56 and 58 from being pulled through aperture 52 to thereby prevent line 54 from being pulled from hollow ball 48. When a force is exerted between line 54 and hollow ball 48, as may occur when hollow ball 48 is struck by a racket or other instrument or when a tether line exerts a force on hollow ball 48 via flexible line 54, knots 56 and 58 will contact boss 51 which will distribute the force over an area of hollow ball 48 adjacent aperture 52. Knots 56 and 58 have the effect of a single knot of a size equal to the combined size of knots 56 and 58, yet knots 56 and 58 may be inserted separately through aperture 52 when manufacturing game ball 47 or if it is desired to replace line 42.

Optionally, and as shown in FIG. 6, that portion of line 54 that extends exteriorly of hollow ball 48 as a loop may be knotted to form an exterior knot 60. Exterior knot 60 serves to effectively terminate the loop between knot 60 and hollow ball 48 so that that portion of line 54 functions as a single line, rather than part of a loop. As a result, the force exerted upon line 54 can be evenly distributed over each end of line 54.

According to the invention, the ball may be made of rubber or any resilient material. Perferably, the ball will be made from a cross-linked synthetic rubber compound so that when formed in a pressureless hollow ball, characteristics similar to that of a racquetball will result. Alternatively, larger or smaller balls can be constructed according to the invention. Lines 17, 30, and 54 are preferably constructed of nylon cord.

The design of the ball according to the invention provides a tetherable ball which is simple to construct in addition to being durable. Hollow ball 12 can be manufactured by any method or material known to those skilled in the art. For example, compression molding can be used to form a synthetic cross-linked rubber into a hollow ball having rebound and elastic characteristics similar to a racquetball and incorporating the formation of the aperture or apertures of the desired configuration. In the embodiments described herein, the apertures can function as one-way valves for force distributing plug 20 in the embodiment shown in FIG. 1 and for knot 32 in the embodiment shown in FIG. 3. Force distributing plug 20 and knot 32 can be inserted through the aperture into the hollow portion of hollow ball 12, yet the aperture will restrain plug 20 or knot 32 from being extracted therefrom. The elastic properties of hollow ball 12 allow the aperture to stretch to permit the insertion of force distributing plug 20, knot 32 or knots 56 and 58. The simplicity of construction allows line 30 or line 54 to be easily replaced, should this become necessary.

FIG. 5 is an illustration of the tetherable game ball being used in a game for which it is suitable. The tetherable game ball is secured to one end of an elastic tether, the other end of the tether being secured to a suitable base. As illustrated in FIG. 5, the game ball is being used as a racquetball trainer, without the necessity of having a walled court. The game ball of the invention can also be used to play racquetball without a walled court. When game ball 38 in FIG. 5 is struck by racket 40 of player 42, ball 38 moves in the direction in which it is struck until the resistance of elastic tether 44 overcomes the momentum of ball 38 and accelerates ball 38 in a direction towards base 46 and player 42 allowing ball 38 to be struck again and thereby keep ball 38 in play.

While this invention has been described in relation to its preferred embodiments, it is to be understood that various modifications thereof will now be apparent to one skilled in the art upon reading this specification and it is intended to cover such modifications as fall within the scope of the appended claims.

We claim:

1. A game ball that is securable to a tether comprising:

a. a resilient spherical hollow ball having an interior surface and an aperture extending from the interior surface to the exterior surface;

b. a flexible line of predetermined length having two ends extending through said aperture to a position within said hollow ball to form a loop located exteriorly of said hollow ball for securing the tether thereto, both of said ends being knotted independently of each other, said knots being located within said hollow ball and each of said knots being larger than the diameter of said aperture for restraining said line from being pulled from said hollow ball; and c. a boss located interiorly of said hollow ball, said boss being adjacent to and surrounding said aperture for distributing forces exerted between said hollow ball and said line and for reinforcing said hollow ball adjacent said aperture, said aperture extending through said boss, wherein said boss and said ball form a unitary mass.

2. The game ball as recited in claim 1 wherein said boss is conically shaped having its base portion adjacent the interior surface of said hollow ball with said aperture extending through the apex of said boss.

3. The game ball as recited in claim 1 or 2 wherein said loop is knotted exteriorly of said hollow ball to provide a loop that is located entirely apart from said hollow ball and for enabling said line to function as a single line between said aperture and said exterior knot.

4. The game ball as recited in claim 1 wherein said aperture is beveled at the exterior surface of said hollow ball to help prevent tearing of said hollow ball by said line.

* * * * *

UNITED STATES PATENT AND TRADEMARK OFFICE

CERTIFICATE OF CORRECTION

PATENT NO. : 4,272,076

DATED : June 9, 1981

INVENTOR(S) : Jae M. Song and Samuel B. Ligon

It is certified that error appears in the above-identified patent and that said Letters Patent are hereby corrected as shown below:

References Cited: Patent No. 11,887 United Kingdom
date should be 6/1901

Col. 6, line 17, after "interior surface" insert
--and an exterior surface--.

Signed and Sealed this

*Fifth* Day of *January 1982*

[SEAL]

*Attest:*

GERALD J. MOSSINGHOFF

*Attesting Officer*

*Commissioner of Patents and Trademarks*